US012268256B1

(12) United States Patent
Zarcone

(10) Patent No.: US 12,268,256 B1
(45) Date of Patent: Apr. 8, 2025

(54) WEARABLE FOGGING APPARATUS

(71) Applicant: B J Zarcone, Ramona, CA (US)

(72) Inventor: B J Zarcone, Ramona, CA (US)

( * ) Notice: Subject to any disclaimer, the term of this patent is extended or adjusted under 35 U.S.C. 154(b) by 0 days.

(21) Appl. No.: 17/022,491

(22) Filed: Sep. 16, 2020

Related U.S. Application Data

(60) Provisional application No. 62/901,761, filed on Sep. 17, 2019.

(51) Int. Cl.
*A41D 27/08* (2006.01)
*A41B 1/08* (2006.01)
*A63J 5/02* (2006.01)

(52) U.S. Cl.
CPC ..... *A41D 27/08* (2013.01); *A41B 1/08* (2013.01); *A63J 5/025* (2013.01)

(58) Field of Classification Search
CPC .. A41D 27/08; A41D 27/208; A41D 2400/46; A41D 13/0024; A41D 13/0056; A41D 13/0053; A63J 5/025; B44C 1/04; A41B 1/08; A61F 2007/0017; A62B 17/005; A63J 7/005
See application file for complete search history.

(56) References Cited

U.S. PATENT DOCUMENTS 2,527,258 A * 10/1950 Kahn ..... A41D 3/00 2/115
2,629,195 A * 2/1953 Casha ..... A41D 27/08 112/420
3,242,979 A * 3/1966 Shlosinger ..... A41D 13/0053 165/DIG. 46
3,468,299 A * 9/1969 Amato ..... A41D 13/0025 607/104
3,608,092 A * 9/1971 Taranto ..... A41B 13/10 428/138
3,705,836 A * 12/1972 Francis et al. ..... A41D 27/08 442/104
3,777,310 A * 12/1973 Yang ..... B44C 5/00 446/28
4,120,053 A * 10/1978 Nemirofsky ..... G07F 11/44 2/115
4,310,927 A * 1/1982 DeBose ..... A41D 11/00 446/26
4,365,353 A * 12/1982 Rayl ..... A41D 27/08 446/28
4,813,081 A * 3/1989 Cliff ..... A41D 1/04 2/244

(Continued)

*Primary Examiner* — Heather Mangine
*Assistant Examiner* — Raquel M. Weis
(74) *Attorney, Agent, or Firm* — Garson & Gutierrez, PC

(57) ABSTRACT

Wearable fogging apparatus and methods of their manufacture and use are disclosed. In one embodiment, the wearable fogging apparatus consists of a graphics T-shirt that includes graphics disposed thereon. The graphics may include both a permeable portion, through which gases are able to pass therethrough, as well as a non-permeable portion, through which gases are not able to pass therethrough (or are otherwise able to minimize the theatrical effect of gases passing therethrough). A wearer of the wearable fogging apparatus may then emit a fogging agent into, for example, a non-permeable bladder and the vapor may then seep through permeable portions of the graphics T-shirt thereby producing a theatrical effect. Other fogging apparatus, including non-wearable fogging apparatus, are also disclosed.

5 Claims, 4 Drawing Sheets

(56) References Cited

U.S. PATENT DOCUMENTS 4,815,149 A * 3/1989 Erhardt ..... A41D 27/08 2/403
4,823,240 A * 4/1989 Shenker ..... A41D 27/08 362/108
4,834,688 A * 5/1989 Jones ..... A41D 27/08 446/28
4,838,965 A * 6/1989 Bussard ..... B29C 66/1122 2/115
4,914,752 A * 4/1990 Hinson ..... A41D 13/0025 2/457
4,917,372 A * 4/1990 Zeitlin ..... A63J 7/00 2/2.5
4,963,208 A * 10/1990 Muncy ..... D06Q 1/12 156/583.8
5,005,218 A * 4/1991 Ganz ..... A41D 27/08 2/244
5,007,113 A * 4/1991 Bouadjadja ..... A41D 15/04 2/115
5,048,123 A * 9/1991 Monson ..... A41D 27/08 446/28
5,079,778 A * 1/1992 Sloot ..... A41D 27/08 2/115
5,251,337 A * 10/1993 Sloot ..... B29C 66/246 446/28
5,281,499 A * 1/1994 Bussard ..... G03H 1/02 2/244
5,438,707 A * 8/1995 Horn ..... A41D 13/0053 2/457
5,626,948 A * 5/1997 Ferber ..... H01H 1/029 428/209
5,901,372 A * 5/1999 Lawler ..... A41D 27/08 2/69
5,933,866 A * 8/1999 Fox ..... A41D 27/08 2/244
5,970,519 A * 10/1999 Weber ..... A41D 13/0025 2/81
6,093,475 A * 7/2000 Geller ..... A41G 7/02 2/9
6,103,047 A * 8/2000 Ogawa ..... B32B 27/40 442/181
6,134,714 A * 10/2000 Uglene ..... A41D 13/0056 2/81
6,175,960 B1 * 1/2001 Knittel ..... A41D 27/08 40/586
6,220,490 B1 * 4/2001 O'Hara ..... A45F 3/16 2/458
6,237,152 B1 * 5/2001 Gootrad ..... A41D 13/012 2/87
6,260,201 B1 * 7/2001 Rankin ..... A41D 13/0053 2/81
6,272,877 B1 * 8/2001 Halloran ..... A41D 13/0053 62/77
6,596,019 B2 * 7/2003 Turner ..... A61F 7/02 607/108
7,000,682 B2 * 2/2006 Chambers ..... A41D 13/005 607/104
7,226,454 B2 * 6/2007 Albrecht ..... A61F 7/00 607/108
7,276,076 B2 * 10/2007 Bieberich ..... A61F 7/00 607/104
7,296,303 B1 * 11/2007 Samet ..... A41D 1/04 2/115
7,527,612 B1 * 5/2009 Carpenter ..... A61F 7/02 604/291
7,665,156 B1 * 2/2010 Hewitt ..... A41D 13/0518 224/148.1
7,716,940 B2 * 5/2010 Farnworth ..... A62B 17/005 62/259.3
7,846,192 B2 * 12/2010 Panser ..... A61F 7/00 607/104
8,015,618 B2 * 9/2011 Paull ..... A41D 13/0053 2/69
8,043,350 B2 * 10/2011 Anderson ..... A61F 7/02 607/104
8,465,351 B2 * 6/2013 Smith ..... A41D 13/0025 165/61
8,602,855 B2 * 12/2013 Turner ..... A41D 13/0025 165/61
9,009,867 B2 * 4/2015 Bowen ..... A41D 1/00 2/144
9,095,178 B1 * 8/2015 Mankaruse ..... A41D 13/012
9,173,441 B2 * 11/2015 Chumbler ..... G09F 3/20
9,179,719 B1 * 11/2015 Goldberg ..... A41D 13/0015
9,220,854 B1 * 12/2015 Okrusko ..... A61M 16/00
9,332,796 B2 * 5/2016 Edwards ..... A41D 1/04
9,342,996 B2 * 5/2016 King ..... G09B 9/00
9,414,666 B2 * 8/2016 Smith ..... A41D 3/00
9,615,649 B2 * 4/2017 Melling ..... A45F 3/16
2001/0000849 A1 * 5/2001 Siman-Tov ..... A61F 7/10 62/259.3
2002/0124294 A1 * 9/2002 Mckenzie ..... A41D 13/0002 2/69
2002/0170309 A1 * 11/2002 Strauss ..... F24F 5/0035 62/259.3
2004/0055072 A1 * 3/2004 Lee ..... A41D 13/0053 2/171
2004/0168459 A1 * 9/2004 Blackstone ..... B60H 1/3235 2/DIG. 1
2005/0246813 A1 * 11/2005 Davis ..... A41D 13/0053 2/69
2006/0003688 A1 * 1/2006 Turner ..... A41D 13/0025 454/370
2006/0079855 A1 * 4/2006 Hooper ..... G09B 23/30 2/48
2006/0086821 A1 * 4/2006 Junkel ..... B05B 9/0877 239/302
2006/0191063 A1 * 8/2006 Elkins ..... A62B 17/005 2/458
2008/0067202 A1 * 3/2008 Silva ..... A41D 13/01 362/108
2008/0070476 A1 * 3/2008 Warshaw ..... F41B 9/0031 446/473
2008/0307557 A1 * 12/2008 Bowen ..... A47G 9/1027 2/243.1
2009/0025116 A1 * 1/2009 Dapo ..... A63J 7/005 446/28
2009/0025123 A1 * 1/2009 Weedlun ..... A41D 27/08 2/244
2009/0030656 A1 * 1/2009 Doe, II ..... A41D 27/20 703/1
2009/0136866 A1 * 5/2009 Kronzer ..... B41C 1/14 430/205
2009/0158489 A1 * 6/2009 White ..... G09F 21/02 2/244
2009/0298034 A1 * 12/2009 Parry ..... G09B 23/30 434/274
2010/0005694 A1 * 1/2010 Forte ..... A47G 1/0616 40/757
2010/0011489 A1 * 1/2010 Goldmann ..... A41D 31/14 2/455
2010/0125928 A1 * 5/2010 Smith ..... B63C 11/08 165/61
2011/0185469 A1 * 8/2011 Santuccio ..... A41D 27/205 2/69
2011/0277207 A1 * 11/2011 Weinshanker ..... B44F 11/00 2/69
2012/0003621 A1 * 1/2012 Segall ..... G09B 23/32 434/272
2012/0167270 A1 * 7/2012 Strong ..... A43B 3/0078 2/69
2014/0057510 A1 * 2/2014 Beach-Drummond ..... B63C 9/1255 441/90
2014/0073208 A1 * 3/2014 Jansen ..... B63C 9/1255 441/98
2014/0082814 A1 * 3/2014 Rober ..... A41D 27/205 2/84

(56) References Cited

U.S. PATENT DOCUMENTS

| | | | | |
|---|---|---|---|---|
| 2014/0102573 | A1* | 4/2014 | Larocque | F17D 3/00<br>2/113 |
| 2014/0148075 | A1* | 5/2014 | Rakhecha | A41D 27/08<br>446/71 |
| 2014/0318699 | A1* | 10/2014 | Longinotti-Buitoni | H05K 1/095<br>156/247 |
| 2015/0074866 | A1* | 3/2015 | Diakite | A41D 27/20<br>2/69 |
| 2015/0216242 | A1* | 8/2015 | Evans | A41D 13/1236<br>2/114 |
| 2016/0135573 | A1* | 5/2016 | Smith | A41D 27/00<br>222/175 |
| 2016/0302501 | A1* | 10/2016 | Peterson | A41D 27/20 |
| 2017/0071275 | A1* | 3/2017 | Darby | A41B 17/005 |
| 2017/0340472 | A1* | 11/2017 | Turner | A61F 5/028 |
| 2018/0146729 | A1* | 5/2018 | Helferstay | A41D 27/08 |
| 2018/0229822 | A1* | 8/2018 | Sunol | B63C 9/1255 |
| 2018/0348862 | A1* | 12/2018 | Weston | A41D 27/08 |
| 2019/0008219 | A1* | 1/2019 | Davidovits | F28D 5/00 |
| 2019/0059562 | A1* | 2/2019 | Escava | A45F 3/005 |
| 2019/0060164 | A1* | 2/2019 | Vo | A41D 13/0525 |
| 2020/0281284 | A1* | 9/2020 | Mcallister | A41D 13/0053 |

* cited by examiner

WEARABLE FOGGING APPARATUS

PRIORITY

This application claims the benefit of priority to U.S. Provisional Application Ser. No. 62/901,761 filed Sep. 17, 2019 of the same title, the contents of which being incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE DISCLOSURE

1. Technological Field

The present disclosure relates generally to wearable fogging apparatus, and more particularly in one exemplary aspect to a fogging apparatus implemented within a graphics T-shirt that enables a wearer of the graphics T-shirt to provide a theatrical effect to the graphics present on the graphics T-shirt.

SUMMARY

The present disclosure provides, inter alia, a wearable fogging apparatus as well as methods of manufacture and their use.

In one aspect, a graphics t-shirt is disclosed. In one embodiment, the graphics t-shirt includes a t-shirt having graphics that are disposed thereon, the graphics including both a permeable portion as well as a non-permeable portion; a bladder that is coupled with the graphics, the bladder being coupled with a channel having an opening disposed adjacent a collar of the t-shirt. A wearer of the t-shirt may emit a fogging agent into the channel via the opening, thereby producing a theatrical effect using the graphics of the t-shirt.

In another aspect, a wearable fogging apparatus is disclosed.

In yet another aspect, methods of manufacturing the aforementioned graphics t-shirt or the aforementioned wearable fogging apparatus is disclosed.

In yet another aspect, methods of using the aforementioned graphics t-shirt or the aforementioned wearable fogging apparatus is disclosed.

Other features and advantages of the present disclosure will immediately be recognized by persons of ordinary skill in the art with reference to the attached drawings and detailed description of exemplary implementations as given below.

BRIEF DESCRIPTION OF THE DRAWINGS

The features, objectives, and advantages of the disclosure will become more apparent from the detailed description set forth below when taken in conjunction with the drawings, wherein.

Figure 1A:
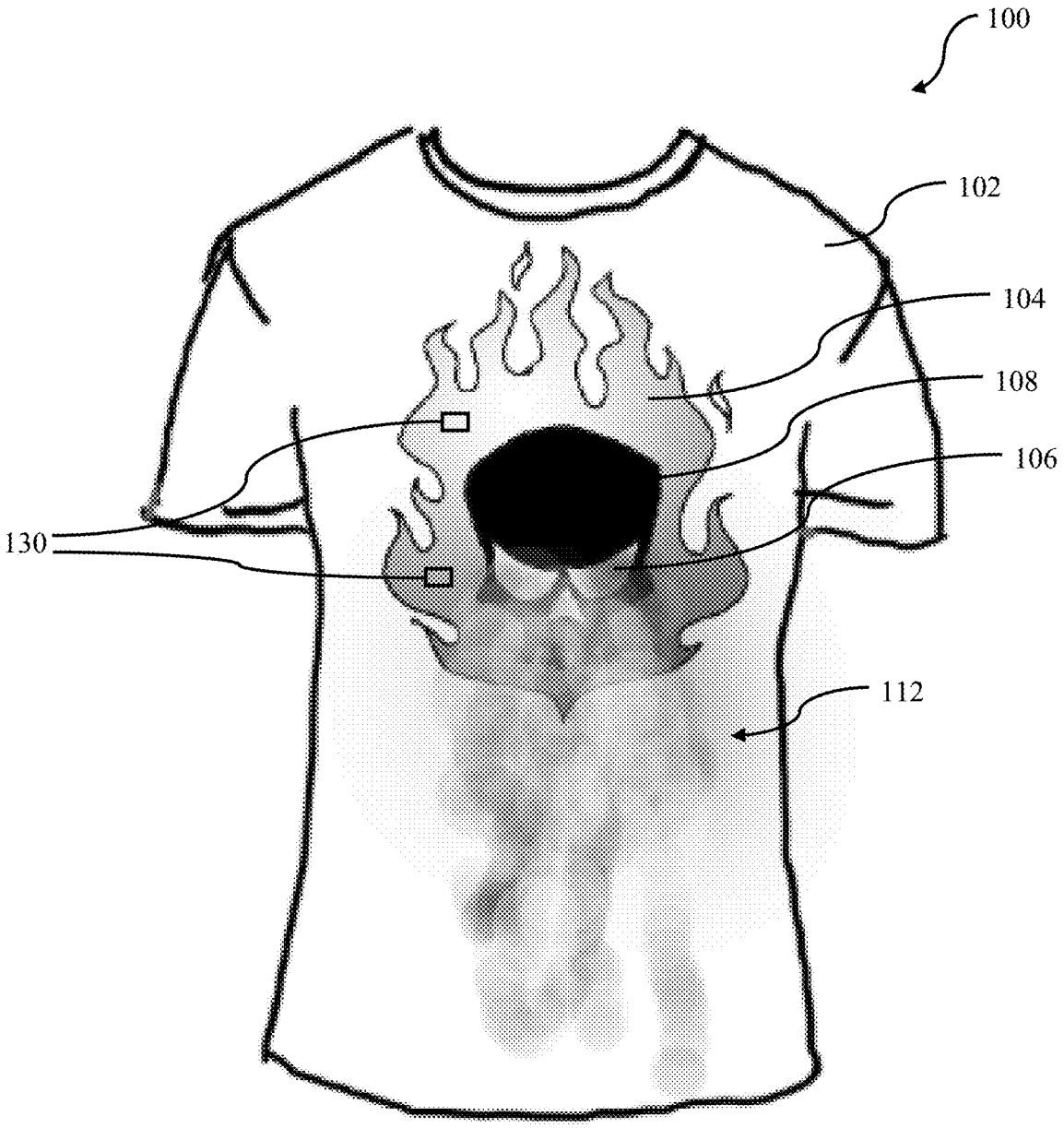
FIG. 1A is a front elevation view a wearable fogging apparatus, in accordance with the principles of the present disclosure.

All FIGURES disclosed herein are © Copyright 2019 B J Zarcone.

All rights reserved.

DETAILED DESCRIPTION

Detailed descriptions of the various embodiments and variants of the apparatus and methods of the present disclosure are now provided. It is noted that wherever practicable similar or like reference numbers may be used in the figures and may indicate similar or like functionality. The FIGURES depict embodiments of the disclosed apparatus for purposes of illustration only. One skilled in the art will readily recognize from the following description that alternative embodiments of the structures and methods illustrated herein may be employed without necessarily departing from the principles described herein.

While primarily discussed in the context of application of the fogging apparatus to a graphics T-shirt, it would be readily apparent to one of ordinary skill given the contents of the present disclosure that the present disclosure is not so limited. For example, the principles of the present disclosure may be readily applied to other wearable products including, without limitation, costumes (e.g., Halloween costumes, cosplay costumes, etc.), jerseys, coats, jackets, sweaters, hoodies, helmets, masks and the like. These and other variants would be readily apparent to one of ordinary skill given the contents of the present disclosure.

Moreover, while primarily discussed in the context of application of the fogging apparatus to wearable items, it would be readily apparent to one of ordinary skill given the contents of the present disclosure that the present disclosure is not so limited. For example, the principles of the present disclosure may be readily applied to non-wearable items possessing both permeable and non-permeable surfaces including, without limitation, posters (e.g., movie posters, band posters, etc.), artwork (paintings, sculptures, etc.), haunted house props, coffee mugs and other types of cups or vessels for containing liquids, and other non-wearable objects. As but one non-limiting example, the principles of the present disclosure may be applied to so-called "bubble machines". Bubble machines may use a blower motor to produce bubbles having a hollow sphere. The blower motor may, in addition to air, emit a fogging material (e.g., vapor) into the produced bubbles thereby producing a theatrical effect when the bubbles later burst thereby releasing the fogging material from the bubble. These and other variants would be readily apparent to one of ordinary skill given the contents of the present disclosure.

Wearable Fogging Apparatus—

Implementations of the present technology will now be described in detail with reference to the drawings, which are provided as illustrative examples so as to enable those skilled in the art to practice the technology. Notably, the figures and examples below are not meant to limit the scope of the present disclosure to a single implementation or implementations, but other implementations are possible by way of interchange of or combination with some or all of the described or illustrated elements. Wherever convenient, the same reference numbers will be used throughout the drawings to refer to same or similar parts and/or functionality.

Referring now to FIGS. 1A-1D, one exemplary wearable apparatus 100 is shown and described in detail. The wearable apparatus 100 of FIGS. 1A-1D is embodied as a graphics T-shirt 102, although it would be readily apparent to one of ordinary skill given the contents of the present disclosure that the present disclosure is intended to be limited to the specific implementation example illustrated in FIGS. 1A-1D as discussed supra. In FIG. 1A, the t-shirt 102 includes graphics 104 disposed thereon. In the illustrated example, the graphics depict a skull with flames disposed around the skull. The graphics 104 include both a permeable portion 106, through which gases are able to pass therethrough, as well as a non-permeable portion 108, through which gases are not able to pass therethrough (or are otherwise able to minimize the theatrical effect of gases passing therethrough). In some implementations, the graphics 104 may include light sources 130 such as, for example, one or more light-emitting diodes (LEDs) 130 that may be utilized in conjunction the wearable fogging apparatus in order to increase the theatrical effect of the fogging apparatus. While the use of LEDs 130 is exemplary, it would be readily appreciated that other types of light sources 130 (e.g., lasers, incandescent light sources, etc.) may be readily substituted in some variants of the present disclosure.

In the illustrated example, the eyes and nose of the skull consist of permeable material 106, while the flames and skull itself consist of non-permeable material 108. For example, the permeable material 106 may consist of the underlying fabric the T-shirt 102 is made from. For example, cotton, nylon and polyester (dependent upon yarn size and the knit or weave of the fabric), rayon, linen, silk, wool and the like, may be used for the permeable portion 106 of the T-shirt 102. The non-permeable portion 108 of the T-shirt may 102 consist of a plastic-based ink typically utilized in the manufacture of, for example, screen printed T-shirts. For example, the plastic-based ink may consist of plastisol, which is a suspension of polyvinyl chloride (PVC) or other polymer particles in a liquid plasticizer. While specific material examples have been provided, it would be readily appreciated by one of ordinary skill given the contents of the present disclosure that other permeable 106 and non-permeable 108 materials may be readily substituted with equal success given the contents of the present disclosure.

Moreover, while the illustrated graphics 104 depict a skull with flames disposed around the skull, it would be readily envisaged that other suitable graphics may be depicted with equal success. For example, a dragon could be depicted such that a fog exits the mouth of the dragon. Super-hero logos could be depicted with strategic placement of the permeable and non-permeable portions (e.g., fog emanating from around the Batman® logo); famous FIGURES could be depicted that appear to have smoke emanate from their mouths, hair, etc. (e.g., a Bob Marley image, the Marlboro® man, Arnold Schwarzenegger smoking a cigar, etc.). The possibilities are limitless, with the imagination of the artist being the sole limitation.

The smoke or vapor 112 emanating from the T-shirt 102 could take on any number of suitable forms. For example, the smoke or vapor 112 may be resultant from an electronic cigarette or so-called "e-cigarette". The smoke or vapor 112 from an e-cigarette may be particularly advantageous due to the relative volume of the vapor as compared with traditional smoke resultant from tobacco or marijuana. Additionally, the smoke or vapor 112 from an e-cigarette may be relatively odorless or may be infused with more desirable odors as compared with tobacco or marijuana smoke. In some implementations, the smoke or vapor 112 emanating from tobacco or marijuana smoke may be readily substituted with equal theatrical success. Other forms of fogging or smoke agents may be readily substituted in some embodiments.

Figure 1B:
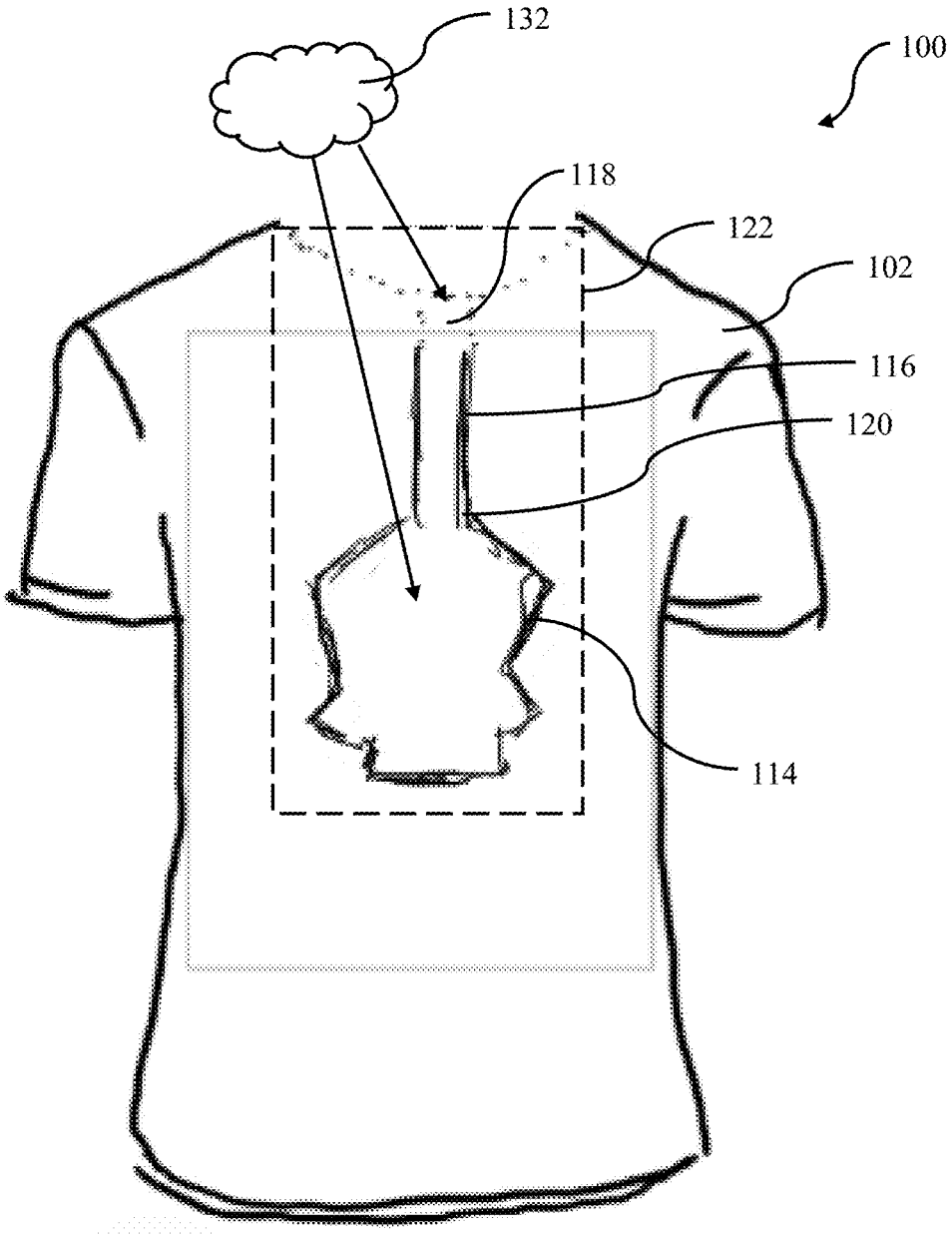
FIG. 1B is a partial cross-section of the front elevation view of the wearable fogging apparatus of FIG. 1A, in accordance with the principles of the present disclosure.
Figure 1C:
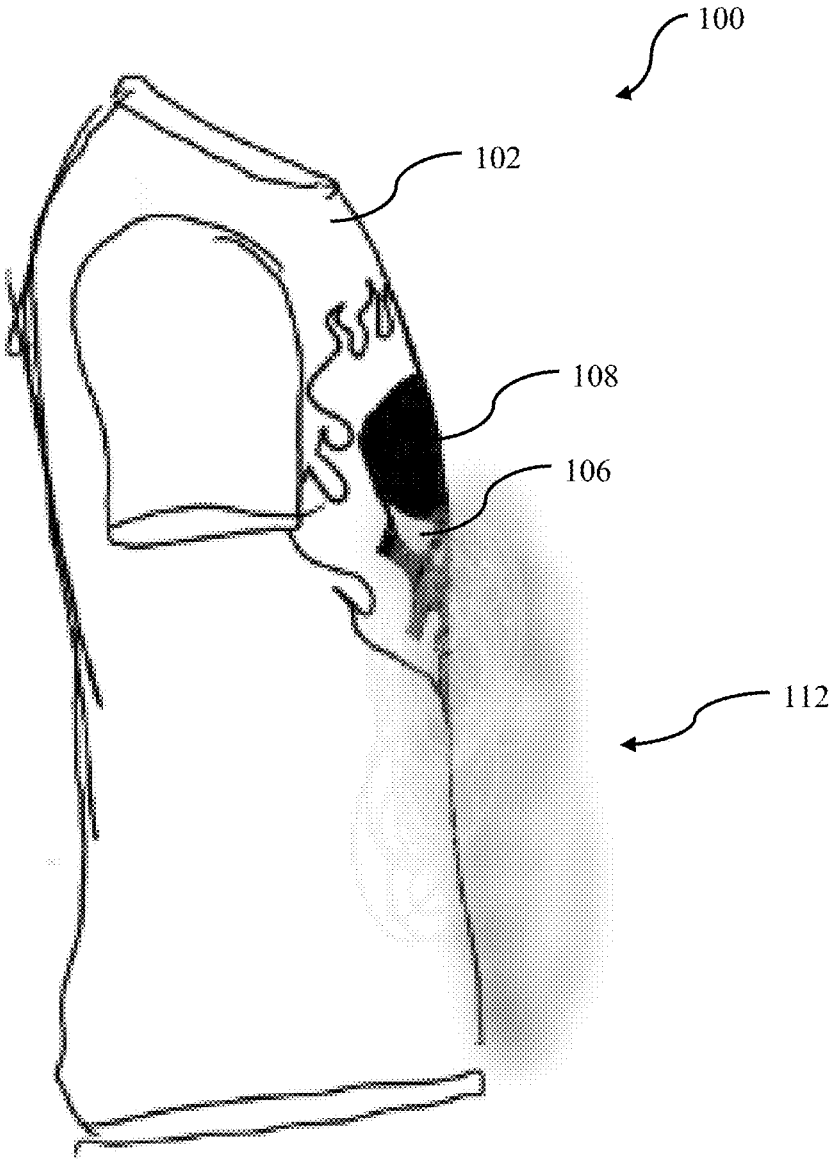
FIG. 1C is a left-side elevation view of the wearable fogging apparatus of FIG. 1A, in accordance with the principles of the present disclosure.

Referring now to FIG. 1B, a cutaway view of the t-shirt 102 depicted in FIG. 1A is shown and described in detail. In particular, a non-permeable bladder 114 may be sewn or otherwise attached to the under-side of the t-shirt 102. This non-permeable bladder 114 may be considered "one-sided" as one side of this non-permeable bladder 114 may consist of the t-shirt 102, and in particular, the graphics 104 of the t-shirt. The specific/size shape of the non-permeable bladder 114 may be dependent upon the graphics 104 themselves. Preferably, the material chosen for the non-permeable bladder 114 may be made for the comfort of the wearer. For example, the non-permeable bladder 144 may be manufactured from a polyurethane laminate (PUL) fabric. PUL fabric may include a lightweight polyester interlock (knit) fabric that is coupled with a thermoplastic polyurethane that are bonded together into a single fabric using a combination of heat, pressure and an adhesive. Other suitable non-permeable materials may be utilized in addition to, or alternatively than, the aforementioned PUL fabric. Connected with the non-permeable bladder 114 is a passageway or channel 116, with one end having an opening 118 to the channel 116 and the other end attached at the channel/bladder interface 120. The channel 116 may be constructed from a similar material as the non-permeable bladder 114 or may be constructed from rigid or semi-rigid materials in order to facilitate the passage of smoke or vapor 112. For example, a light fabric (for the comfort of the wearer) may be overlaid onto a thin plastic hose (e.g., silicone, rubber, polymer-based, etc.) or other suitable non-permeable material.

Figure 1D:
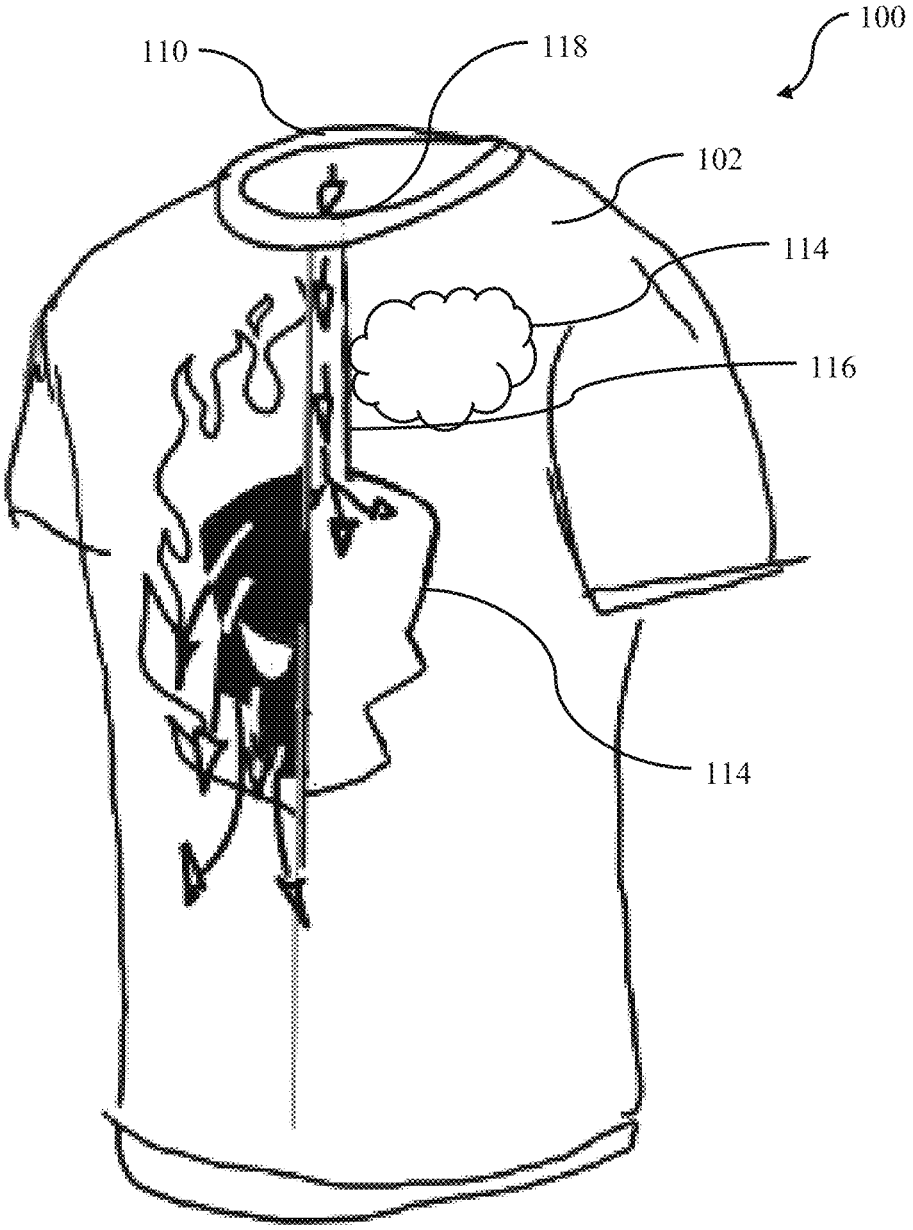
FIG. 1D is a partial cross-section perspective view of the wearable fogging apparatus of FIG. 1A, in accordance with the principles of the present disclosure.

FIG. 1D illustrates one exemplary methodology for bringing the graphic 104 of the T-shirt 102 "to life". For example, the opening 118 to the channel 116 may be located adjacent to the collar 110 of the T-shirt 102. The wearer of the T-shirt 102 may inhale, for example, the smoke or vapor 112 from an e-cigarette and may expel the inhaled smoke into the channel 116 where it fills the non-permeable bladder 114 and is expelled outside the permeable portion(s) 106 of the T-shirt 102.

In some implementations, the opening 118 may be coupled with a portable smoke or vapor machine 132. The portable smoke or vapor machine 132 may be activated in order to turn on a fan that expels the smoke or vapor 112 into the channel 116 and/or non-permeable bladder 114. Such an implementation may be desirable as the wearer of the T-shirt 102 would not have to inhale potentially harmful smoke or vapor 112 in order to activate the function of the T-shirt 102. This portable smoke or vapor machine 132 may be activated using a wired or wireless (e.g., Bluetooth®) controller. For example, this controller may be a separate device, or may even be embodied as software located within, for example, the wearer's smartphone. Two or more non-permeable bladders 114 may be activated independently from one another in order to add further creativity to the underlying design. For example, one button or control may re-create a FIGURE smoking, while another button or control may re-create flatulence for the FIGURE. These and other implementations would be readily apparent to one of ordinary skill given the contents of the present disclosure.

It will be recognized that while certain aspects of the present disclosure are described in terms of specific design examples, these descriptions are only illustrative of the broader methods of the disclosure and may be modified as required by the particular design. Certain steps may be rendered unnecessary or optional under certain circumstances. Additionally, certain steps or functionality may be added to the disclosed embodiments, or the order of performance of two or more steps permuted. All such variations are considered to be encompassed within the present disclosure described and claimed herein.

While the above detailed description has shown, described, and pointed out novel features of the present disclosure as applied to various embodiments, it will be understood that various omissions, substitutions, and changes in the form and details of the device or process illustrated may be made by those skilled in the art without departing from the principles of the present disclosure. The foregoing description is of the best mode presently contemplated of carrying out the present disclosure. This description is in no way meant to be limiting, but rather should be taken as illustrative of the general principles of the present disclosure. The scope of the present disclosure should be determined with reference to the claims.

What is claimed is:

1. A graphics t-shirt, comprising:

graphics that are disposed on an outer surface of the t-shirt, the t-shirt comprising graphics comprising both a permeable portion through which smoke or vapor is able to pass through the outer surface of the t-shirt as well as a non-permeable portion in which the smoke or vapor is unable to pass through the outer surface of the t-shirt;

a non-permeable bladder that is coupled with an interior surface of the t-shirt such that an internal volume is formed between the interior surface of the t-shirt and the non-permeable bladder, the internal volume receives the smoke or vapor via a non-permeable channel having an opening, the non-permeable channel being coupled with the internal volume;

wherein the non-permeable channel is configured to allow a wearer to place the smoke or vapor into the non-permeable channel via the opening, thereby producing a theatrical effect using the graphics of the t-shirt whereby the smoke or vapor is able to pass through the permeable portion of the graphics of the t-shirt and whereby the smoke or vapor is not able to pass through the non-permeable portion of the graphics of the t-shirt; and wherein the non-permeable bladder does not allow the smoke or vapor to pass through the non-permeable bladder into an interior volume of the t-shirt that resides outside of the internal volume formed between the interior surface of the t-shirt and the non-permeable bladder; and wherein the non-permeable bladder is sewn or otherwise attached to the interior surface of the t-shirt.

2. The graphics t-shirt of claim 1, wherein the non-permeable portion of the graphics of the t-shirt comprises a plastic-based ink.

3. The graphics t-shirt of claim 2, wherein the plastic-based ink comprises plastisol.

4. The graphics t-shirt of claim 1, wherein the non-permeable bladder comprises a polyurethane laminate (PUL) fabric.

5. The graphics t-shirt of claim 1, wherein the opening of the non-permeable channel is disposed adjacent a collar of the t-shirt.

* * * * *